United States Patent [19]

Ono et al.

[11] 4,104,956

[45] Aug. 8, 1978

[54] RADIAL PISTON TYPE MULTI-STROKE HYDRAULIC PUMP OR MOTOR

[75] Inventors: Kozo Ono, Tokyo; Taketoshi Kato, Funabashi, both of Japan

[73] Assignee: Hitachi Construction Machinery Co., Ltd., Japan

[21] Appl. No.: 767,338

[22] Filed: Feb. 10, 1977

Related U.S. Application Data

[63] Continuation of Ser. No. 141,945, May 10, 1971, abandoned, which is a continuation of Ser. No. 830,622, Jun. 5, 1969, abandoned.

[30] Foreign Application Priority Data

Jun. 10, 1969 [JP] Japan ..... 44-39401

[51] Int. Cl.[2] ..... F01B 13/06

[52] U.S. Cl. ..... 91/491

[58] Field of Search ..... 91/491, 498; 92/57; 417/273

[56] References Cited

U.S. PATENT DOCUMENTS

| | | | |
|---|---|---|---|
| 1,723,874 | 8/1929 | Large | 417/539 |
| 1,766,610 | 6/1930 | Davis | 417/539 |
| 2,882,831 | 4/1959 | Danneuig | 91/498 |
| 2,992,619 | 7/1961 | Nilges | 91/498 |
| 3,046,950 | 7/1962 | Smith | 91/491 |
| 3,151,529 | 10/1964 | Leath | 91/491 |
| 3,561,329 | 2/1971 | Firth | 417/273 |
| 4,048,906 | 9/1977 | Firth et al. | 91/491 |

FOREIGN PATENT DOCUMENTS

| | | | |
|---|---|---|---|
| 253,583 | 9/1969 | U.S.S.R. | 91/491 |
| 253,584 | 9/1969 | U.S.S.R. | 91/491 |

OTHER PUBLICATIONS

Selection of the Track Profile for a Radial-Piston High--Torque Hydraulic Motor by Yu F. Ponomarenko, published in Russian Journal, Dec. 1961.

*Primary Examiner*—William L. Freeh

*Attorney, Agent, or Firm*—Craig & Antonelli

[57] ABSTRACT

In radial piston type multi-stroke hydraulic pump or motor having undulating cam surface, said cam surface is constructed based upon an asymmetrical trapezoid torque curve (of torque-phase diagram), thereby preventing the abrasive wear of the cam surface and faulty operations of valve means due to shorter valve switching time and also maintaining the torque constant.

1 Claim, 18 Drawing Figures

RADIAL PISTON TYPE MULTI-STROKE HYDRAULIC PUMP OR MOTOR

Figure 1:
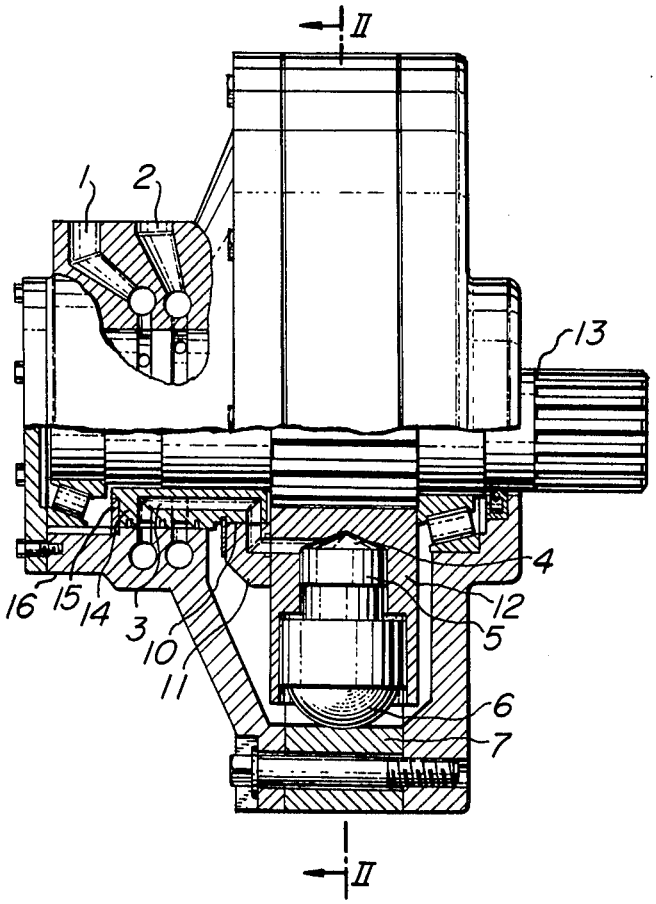

This is a continuation, of application Ser. No. 141,945 filed May 10, 1971 now abandoned, which in turn was a continuation of application Ser. No. 830,622 filed Jun. 5, 1969 now abandoned.

The present invention relates to an improvement of a radial piston type multi-stroke hydraulic pump or motor.

Generally the radial piston type multi-stroke hydraulic pump or motor comprises a rotor having a plurality of radially directed cylinder bores in symmetrically arranged relation about the axis thereof, pistons each being reciprocably mounted in said cylinder bore, a cam member encircling said rotor, said rotor being mounted for rotatable movement with respect to said cam member, said cam member being formed with an undulating cam surface, said pistons each including roller means on the outer end thereof for rolling engagement with said cam surface valve means for controlling the flow of hydraulic fluid to and from the respective cylinder bores and each of said pistons being adapted to make reciprocating motions, frequency of said reciprocating motions, frequency of said reciprocating motions for one rotation of said rotor being determined by the number of the peaks of said undulating cam surface.

In the radial piston type multi-stroke hydraulic pump or motor having the undulating cam surface of the type described, from the viewpoint of the design the radius of curvature along the peak portion of the cam surface is smaller so that the contact pressure produced between the peak portion of the cam surface and the roller means, generally a steel ball secured to the outer end of the piston is inevitably increased, resulting in the shorter service lives of both of the cam surface and the steel ball. The valve means of the pump or motor of the type described must undergo frequent switching from one state to another as the rotor rotates, the number of valve switchings being equal to that of the peaks of the cam in one rotation of the rotor. Therefore, as the rotor rotates at higher speed the valve means is switched more frequently so that the switching time becomes shorter accordingly. Because of this shorter valve switching time, faulty valve operations tend to occur. For example, when the valve port is switched from the higher pressure side to the lower pressure side, the cylinder bore is temporarily disconnected or not communicated with both pressure sides while its piston is in its compression stroke so that the cylinder bore is subjected to overpressure. This phenomenon will be referred to "locking" phenomenon hereinafter for brevity as the working oil or hydraulic fluid is locked in the cylinder bore and isolated from the exterior temporarily. Furthermore, in some cases, both of the high and low pressure sides are temporarily intercommunicated with each other through the cylinder bore. This phenomenon will be referred to as "blow-by" phenomenon hereinafter for brevity as this phenomenon is similar to the leakage between the cylinder and its piston.

It is therefore an object of the present invention to provide a radial piston type multi-stroke hydraulic pressure pump or motor having an undulating cam surface having a configuration suitable for not only reducing the contact pressure between the cam surface and a steel ball secured to the outer end of the piston so as to increase the service lives of both of them while eliminating the torque pulsation but also preventing both of "locking" and "blow-by" phenomena liable to occur upon switching of valve ports, thereby effectively reducing the impact caused by the "locking" phenomenon and improving the volumetric efficiency.

Figure 2:
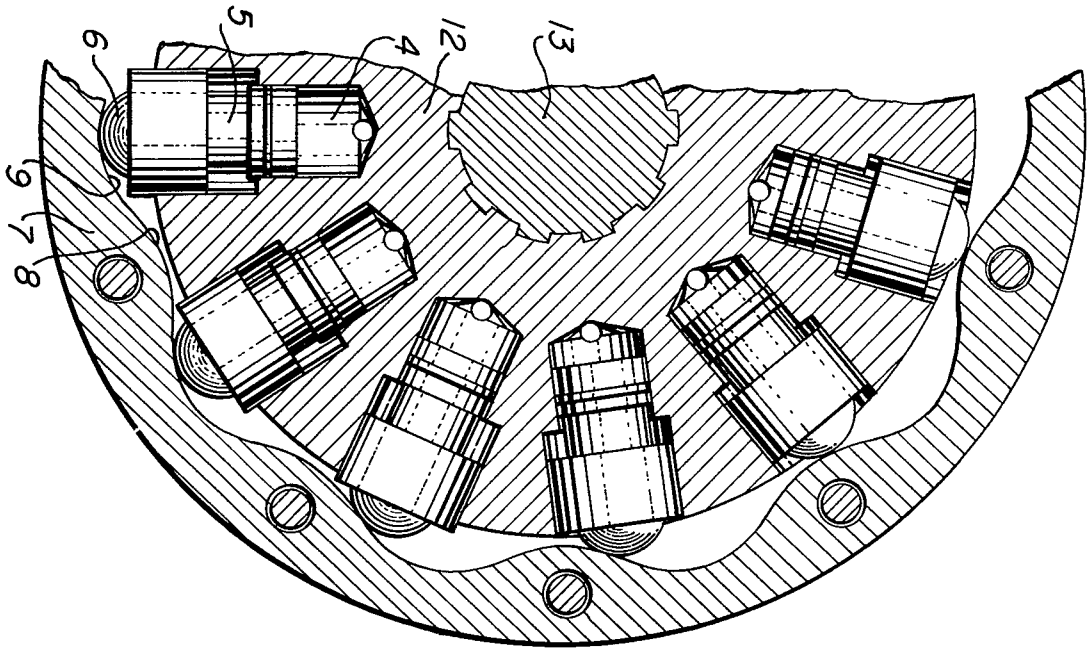
Figure 3:
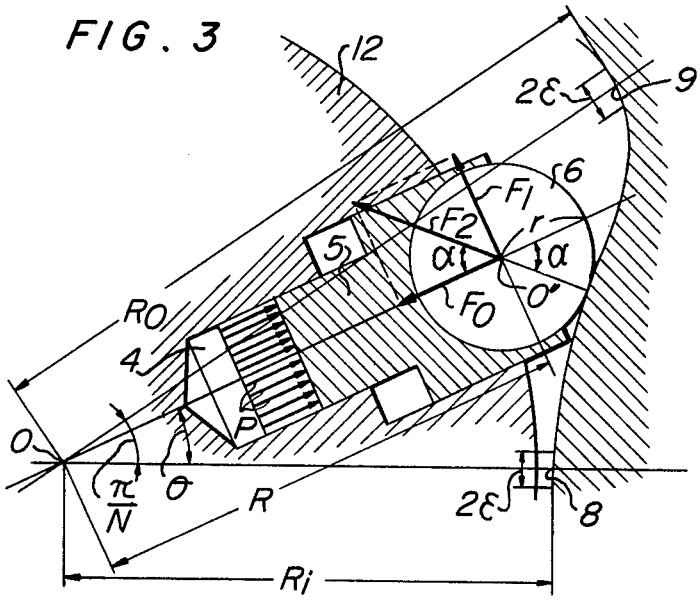
Figure 4:
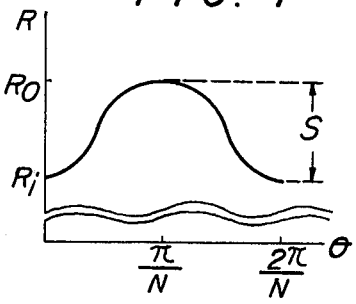
Figure 5:
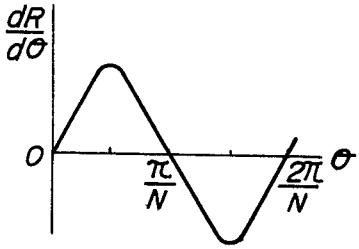
Figure 6:
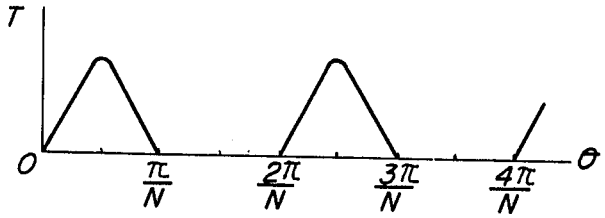
Figure 7:
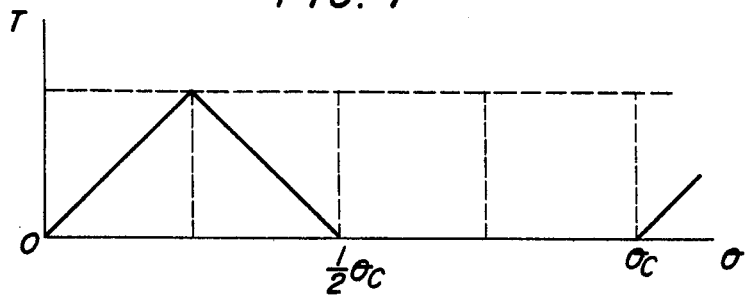
Figure 8:
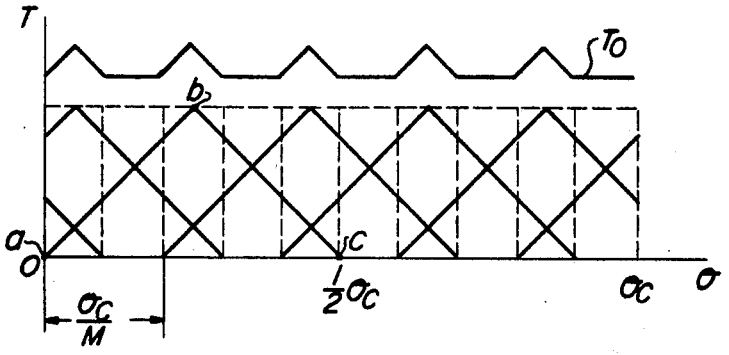
Figure 9:
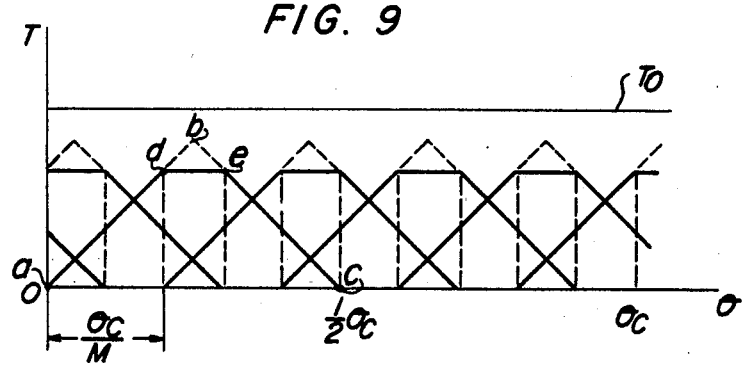
Figure 10:
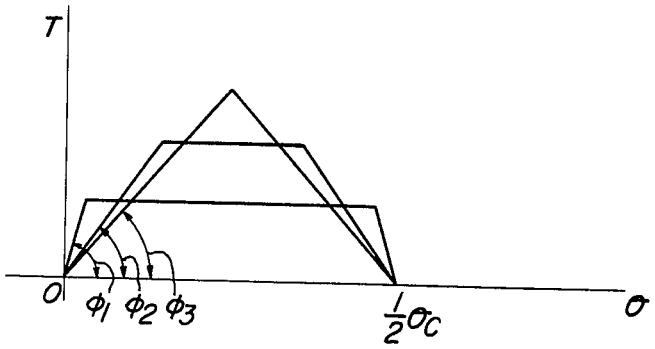
Figure 11:
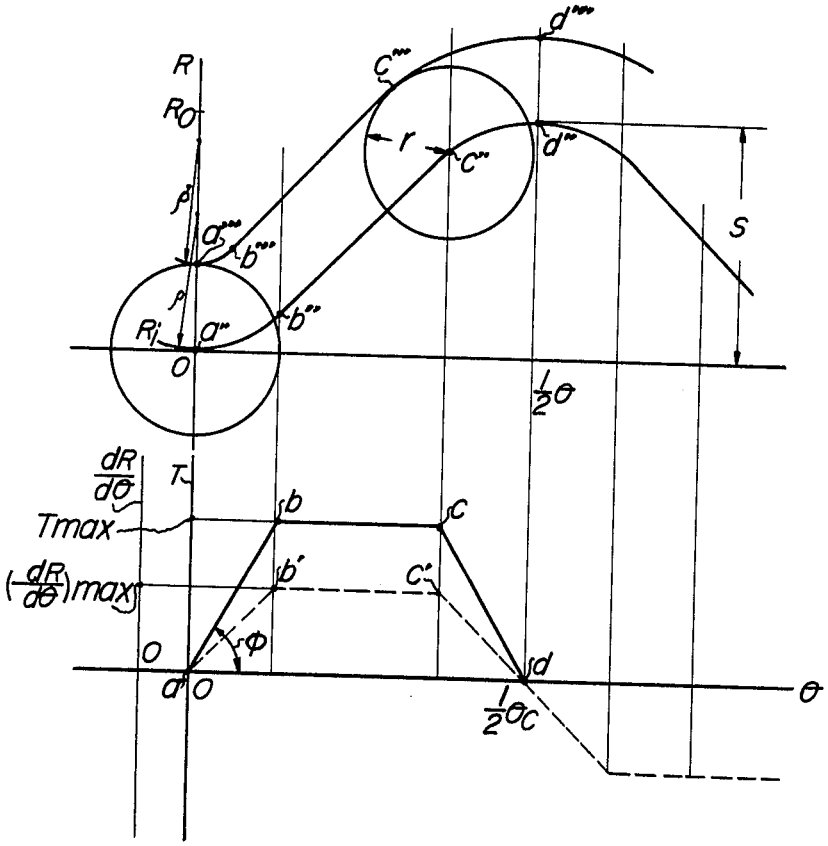
Figure 12:
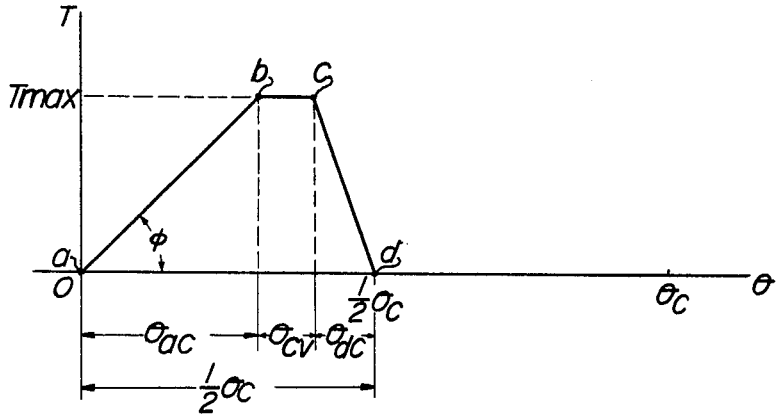
Figure 13:
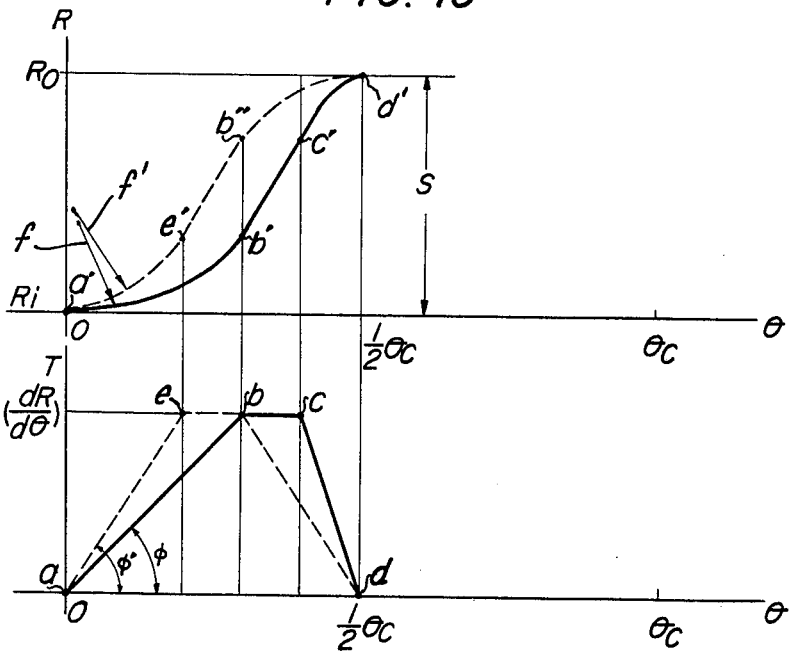
Figure 14:
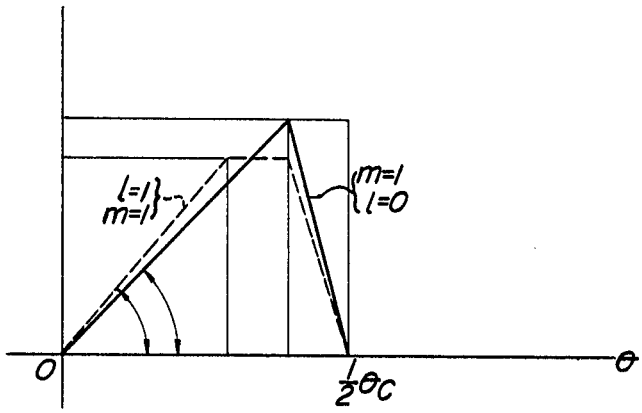
Figure 15:
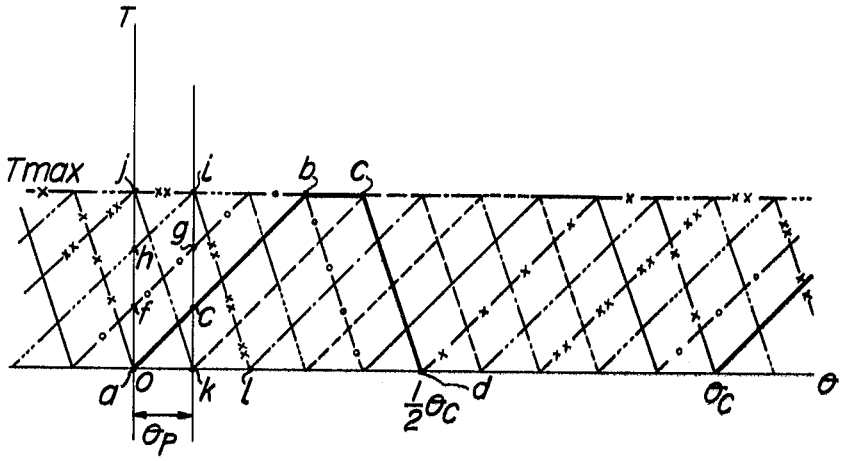
Figure 16:
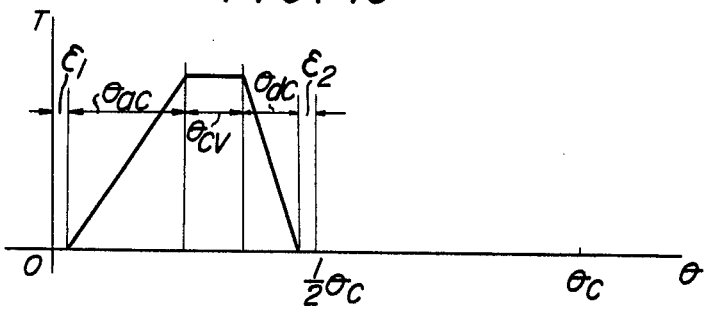
Figure 17:
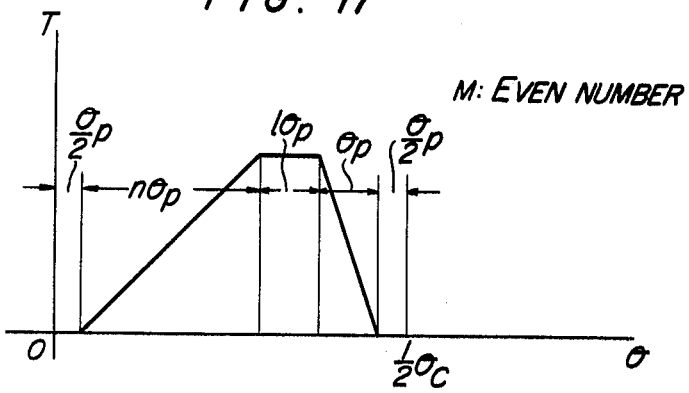
Figure 18:
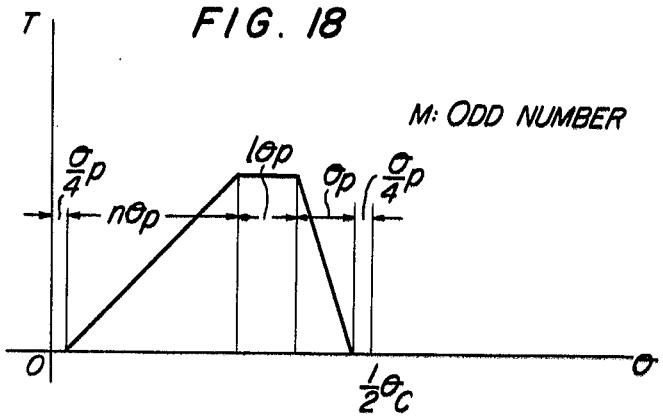

In brief the above objects of the present invention can be accomplished by the provision of an undulating cam surface which has the peak portions each having a larger radius of curvature and the piston dwelling sections formed in the vicinity of the peaks and the troughs of the cam surface and which is constructed based upon an asymmetrical tapezoid torque curve formed so as to maintain constant the summation of torques generated by pistons The above and other objects, features and advantages of the present invention will become more apparent from the following description taken in conjunction with the accompanying drawings in which:

FIG. 1 is a longitudinal sectional view of a radial piston type multistroke hydraulic pressure pump or motor, FIG. 2 is a transverse sectional view thereof taken along the line II—II of FIG. 1, FIG. 3 is an enlarged view similar to FIG. 2 for explanation of the relation between a piston and a cam ring, FIG. 4 is a piston-displacement versus rotor rotation diagram, FIG. 5 is a piston-velocity versus rotor-rotation diagram, FIG. 6 is a piston-torque versus rotor-rotation diagram, FIG. 7 is a diagram similar to FIG. 6 with the torque curve being represented by a triangle, FIG. 8 is an over-all torque diagram, the over-all torque being that produced by all pistons, FIG. 9 is an overall torque diagram amended from the diagram of FIG. 8 to have a constant overall torque, FIGS. 10 and 11 are explanatory views showing a method for increasing the radius of curvature along the peak portion of the cam surface constructed based upon a symmetrical torque diagram, FIG. 12 is an asymmetrical torque diagram for forming the basic cam configuration of the present invention, FIGS. 13 and 14 are explanatory views for comparing the radii of curvature of the peak portion of the cam according to the present invention, FIG. 15 is an explanatory view showing that the summation of torques produced by use of the cam of the present invention becomes constant, and FIGS. 16 to 18 are asymmetrical torque diagrams according to the present invention, FIG. 17 showing the diagram when the number of pistons is an even number while FIG. 18, when an add number.

Referring to FIGS. 1 and 2 showing the construction of a radial piston type multi-stroke hydraulic pump or motor, the working oil under pressure is admitted through a port 1 or 2 and is directed to a cylinder bore 4 through an oil passage 3 so that a steel ball 6 mounted on a piston 5 is pressed against a cam ring 7. The cam ring 7 has an undulating inner surface as shown in FIG. 2 and a valve surface 10 which is adapted to switch the feed passages depending upon the positions of a peak 8 and a trough 9 of the cam surface relative to the piston. That is, a valve outer ring 11 is fixed to a rotor 12 which in turn is keyed by a spline to a shaft 13 while valve inner ring 14 is secured to a casing 16 through a Cardan joint 15 so that the relative movement between the outer and inner rings 11 and 14 is produced upon the valve surface 10 as the rotor 12 is rotated. The valve surface 10 has ports formed at positions corresponding to the peaks 8 and the troughs 9 of the cam ring 7. Thus, upon admission of oil under high pressure into the cylinder bores 4, the rotor 12 is caused to rotate.

Referring now to FIG. 3, let it be that the distance between the center 0 of the rotor 12 and the center 0' of the steel ball 6 be R and that a supplementary angle between the perpendicular constructed at the point of contact between the steel ball 6 and the cam surface and the line 00' be a pressure angle $\alpha$. Then R is a function of an angle $\theta$ of rotation of the rotor so that the following relation is held:

$$\tan \alpha = (dR/d\theta)/R \quad (1)$$

Assuming that the pressure acting upon the piston by hydraulic pressure be Fo, torque T of the force acting upon the center 0' about the center 0 is obtained by:

$$T = R \cdot Fo \cdot \tan \alpha \quad (2)$$

Substituting Eq.(1) into Eq.(2)

$$T = Fo\, dR/d\theta \quad (3)$$

Therefore, the piston velocity diagram as shown in FIG. 5 is obtained based upon the piston displacement diagram shown in FIG. 4, which is the fundamental diagram for determining the cam profile. However, when used as a motor, the period $\theta_T$ during which torque is generated is given by the following relation:

$$2m \cdot \pi/N < \theta_T < (2m+1)\pi/N \quad (4)$$

where

N: number of peaks of a cam surface

*m:* arbitrary integer.

Therefore, the real torque diagram may be substantially shown as in FIG. 6 and it will be seen that one half of one pitch angle $\theta c$ ($= 2\pi/N$) of the cam will serve to produce the torque. The torque diagram as shown in FIG. 6 may be considered as a graph of FIG. 7 in which the curve is represented by lines forming a triangle for the sake of analysis. When the number of pistons is M, the number of triangles *a b c* appeared within the angle $\theta c$ of rotation of the rotor will be M as shown in FIG. 8 and from this figure it will be seen that the over-all torque is fluctuating. Therefore, if the top portion of the triangle *a b c* is truncated by a line *d e*, a trapezoid *a d e c* is formed as shown in FIG. 9 so that the over-all torque can be made constant.

From Eq.(3), it will be seen that the torque T is proportional to the piston velocity $dR/d\theta$ so that the torque diagram for the angle $\theta$ of rotation of the rotor is similar to the piston velocity diagram, $dR/d\theta$. When the piston stroke S is predetermined, a formula $$S = \int_{o}^{\frac{1}{2}\theta c} \frac{dR}{d\theta} \cdot d\theta \text{ is established.}$$

is established.

It is therefore seen that the area encircled by the torque curve remains constant. Considering the radius of curvature at the peak portion of the cam for producing contant torque with the torque diagram shown in FIG. 9, three inclined angles each having a slope or an angle of inclination of $\phi 1$, $\phi 2$ and $\phi 3$ are obtained as shown in FIG. 10. When the slope is the smallest, the torque curve becomes an equilateral triangle and the radius of curvature $\rho$ becomes the minimum in the cam profile constructed based upon this equilateral triangle torque diagram.

This will be described in more detail hereinafter. In case of the trapezoid *a b c d* torque curve shown in FIG. 11, the piston velocity $dR/d\theta$ is shown by *ab'c'd*, and the piston stroke displacement R which is the integrated value of the piston velocity $dR/d\theta$ is shown by *a''b''c''d''*. In this case, the cam configuration or profile becomes an envelop *a'''*, *b'''*, *c'''*, *d'''* formed when the center of a steel ball having a radius of *r* moves along the piston stroke displacement curve *a''b''c''d''* so that it will be understood that the radius of curvature $\rho'$ at the curved point *a'''* becomes smaller than that at the curved point *a''* by *r*. It is preferable that the radius of curvature $\rho'$ at the curved point *a'''* is larger in order to ensure the long service lives of both of the steel balls and the cam surface.

In case of constructing the cam profile from the above described symmetrical torque diagram, the (minimum) value of $\phi$ is limited. However, the value of $\phi$ may be reduced when the torque diagram is formed asymmetrical as shown in FIG. 12. That is, the difference in radii of curvature at the peak portions of the cam obtained from FIGS. 9 and 12 are compared in FIG. 13 on the assumption that the piston stroke S and the time interval of the constant velocity are constant and the number of pistons M is equal to 10. Since the locus of the center of the steel ball obtained from the torque curvature *a e b d* in FIG. 9 becomes *a'e'b''d'*, the radius of curvature in the peak portion of the cam becomes $(\rho - r)$. On the other hand the locus of the center of the steel ball obtained from the curve *a b c d* shown in FIG. 12 becomes *a'b'c'd'* so that the radius of curvature in the peak portion of the cam becomes $(\rho\text{-}r)$, where $\rho$, is the radius of curvature at the curved point *a'* of the curve *a'b'c'd'*. Therefore, $\rho - r > \rho - r$. It is seen that when the torque curve is made asymmetrical the pressure on the contact surface between the peak portion of the cam and the steel ball may be reduced so that the service lives of both of the cam surface and the steel ball can be lengthened.

In this case, since the torque curve is asymmetrical, the over-all torque is fluctuated, but it can be maintained constant when the following conditions are satisfied. That is assuming that the pitch angle $\theta c = 2\pi/N$ and the piston phase differential angle $\theta p = \theta c/M$ (where N: the number of the peaks of the cam and M: the number of pistons)

piston constant velocity interval:

$$\theta cv = l \cdot \theta p \quad (5)$$

piston constant deceleration interval:

$$\theta dc = m \cdot \theta p \quad (6)$$

piston constant acceleration interval:

$$\theta ac = n \cdot \theta dc = m \cdot n \cdot \theta p \quad (7)$$

where

*l* : 0 or integer

*m* and *n:* integers.

Then, $$\theta ac + \theta cv + \theta dc = \theta c/2 \quad (8)$$

Hence, $$m \cdot n + m + l = M/2 \quad (9)$$

If Eq. (9) is satisfied, the over-all torque can be maintained constant. However, this condition is satisfied only when the number of pistons M is an even number. In other words, in order to maintain the over-all torque constant from the torque curve as shown in FIG. 12, the number of pistons M must be an even number. However, an odd integer number of pistons may be used, when means for preventing "locking phenomenon" as will be described in more detail hereinafter, is used, but it is assumed in the further discussion that the over-all torque may be maintained constant when the number of pistons M is an even number in order to obtain the values of $m$ and $n$ satisfying the Eq. (9).

When $l = 0$ and $m = 1$, the radius of curvature at the peak portion of the cam can be made maximum as shown in FIG. 14 so that employing these values in practice is very advantageous. However, in practice, there are two restrictions. One is that as shown in FIG. 12, when the slope of the constant piston velocity deceleration interval is too large, the radius of curvature at the trough portion of the cam becomes substantially equal to the radius of the steel ball, thereby presenting the geometrical problem. The other is such that when the slope of the constant piston deceleration interval $c\ d$ is too large, the piston velocity becomes too fast to switch the valves when the steel ball passes through the trough of the cam so that this is undesired in practice. Thus, it is at least required that $l \geqq 1$ and $m \geqq 2$.

Next referring to FIG. 15, it will be described that the over-all torque in case of the asymmetrical torque diagram of FIG. 12 becomes constant. In this case, $M = 10$, $l = 1$, $m = 1$ and $n = 3$ so that $\theta ac = 3\ \theta p$, $\theta cv = \theta p$ and $\theta dc = \theta p$.

In the fundamental torque diagram of FIG. 15, the torque curve is a trapezoid $a\ b\ c\ d$ and ten such trapezoids appear in an interval of $0 \leqq \theta \leqq \theta c$ with the phase difference of $\theta p$. The torque curves contained within every phase angle difference $\theta$ are similar so that it will be sufficient to show that the over-all torque in the interval of $0 \leqq \theta \leqq \theta c$ is constant. The over-all torque T at the point $\theta = 0$ is given by $$T = \frac{1}{3} T\max + \frac{2}{3} T\max + (T\max \times 2)$$
$$= 3\ T\max.$$

In the interval of $0 < \theta < \theta p$, when the angles of inclination of torque curves in the intervals between $a$ and $e$; $f$ and $g$; and $h$ and $i$ of the uniform piston acceleration are 1, the angle of inclination of the torque curve in the interval between the points $j$ and $h$ of the uniform deceleration become $-3$ so that in this interval there is no variation in torque, that is the over-all torque in this interval is equal to that at the point 0. At the point of $\theta = \theta p$, the torque curve having a slope of 1 between the points $h$ and $i$ disappears, but the torque curve between $k$ and $c$ having the same slope appears, so that the over-all torque T is reduced discontinuously by $T_{max}$. However, the torque curve having the angle of inclination $-3$ between the points $j$ and $k$ is replaced with the similar curve between the points $i$ and $l$ so that the over-all torque T is increased discontinuously by $T_{max}$. Consequently, the over-all torque can be maintained at $3T_{max}$. Thus, it will be seen at all points that the over-all torque is maintained constant.

Next referring to FIG. 16, the method of the present invention for providing the dwelling intervals $\epsilon_1$ and $\epsilon_2$, that is the intervals during which the piston is not actuated in order to prevent the "blow-by" and "locking" phenomena observed when the valves are switched will be described. In FIG. 16, piston constant velocity interval:

$$\theta cv = l \cdot \theta p$$

piston constant deceleration interval:

$$\theta dc = m \cdot \theta p$$

piston constant acceleration interval:

$$\theta ac = n \cdot \theta dc = m \cdot n \cdot \theta p$$

and the dwelling intervals:

$$\epsilon_1 \text{ and } \epsilon_2.$$

Then, the following relation is held:

$$\theta ac + \theta cv + \theta dc + \epsilon_1 + \epsilon_2 = \frac{\theta c}{2} \quad (10)$$

Hence, the summation of the dwelling intervals becomes $$\epsilon_1 + \epsilon_2 = \{M/2 - m(n + 1) - l\}\ \theta p$$

Thus, the dwelling intervals $(\epsilon_1 + \epsilon_2)$ must be selected by finding the values which satisfy Eq. (11). The dwelling intervals $\epsilon_1$ and $\epsilon_2$ may be short so that as shown in FIG. 17, when the number of pistons $M = 12$ within one cam pitch angle, that is when M is an even integer, $\epsilon_1 = \epsilon_2 = \frac{1}{2} \cdot \theta p$. But as shown in FIG. 18 where the number of pistons $M = 11$, that is an odd number, it is so selected that $\epsilon_1 = \epsilon_2 = \frac{1}{4}\ \theta p$. In this case, $l = 0$, or 1 and $n$ is determined depending upon the value of $l$. When the dwelling intervals $\epsilon_1$ and $\epsilon_2$ are selected as described above, the over-all torque may be maintained constant regardless of the fact that the number of pistons M within one cam pitch angle $\theta c$ is an even or odd number. From the foregoing, it will be seen that when the envelop generated by moving the center of the steel ball along the displacement curve obtained by integration of the asymmetrical torque curve satisfying Eq. (11) is obtained, the cam profile or configuration which minimizes the contact pressure between the steel ball and the cam surface and prevents "locking" and "blow-by" phenomena and maintain the over-all torque constant can be constructed.

According to the present invention, the radius of curvature at the peak portion of the cam can be designed large so that the contact pressure between the cam and the steel ball can be reduced, thereby elongating the service lives of both of them, the pressure of the working oil for the hydraulic motor can be increased or the discharge pressure of the hydraulic pump can be increased, and the valve switching interval can be increased as compared with the conventional pump or motor of the type described, whereby can be provided the hydraulic pump or motor which can completely eliminate "locking" and "blow-by" phenomena caused in case of switching the valves and can maintain constant the over-all torque produced by the pistons with the higher volumetric efficiency.

The present invention has been so far described with particular reference to the preferred embodiment thereof, but it will be understood that variations and modifications can be effected without departing the true spirit of the invention as described hereinabove and as defined in the appended claims.

What is claimed is:

1. A radial piston type multi-stroke hydraulic pump or motor comprising a rotor having a plurality of radially extending cylinder bores arranged about the axis thereof, a plurality of pistons each being mounted in each of said cylinder bores for reciprocal movement therein, a cam member encircling said rotor and having a cam surface consisting of a plurality of ridges each having a same configuration, said rotor being rotatable with respect to said cam member, rolling means mounted on the outer end of each of said pistons for rolling contact with said ridges of said cam surface, and valve means for controlling the flow of fluid into and out of said cylinder bores, characterized in that when said rolling means of the piston moves from the peak to the trough of each of said ridges, the radial movement of said piston has a constant acceleration section in which the velocity of said piston continuously increases from zero to maximum with a constant rate, a constant velocity section in which the velocity of said piston is maintained at said maximum, a constant deceleration section in which the velocity of said piston continuously decreases from said maximum at the end of said constant velocity section to zero with a constant rate, and in conjunction with at least either or both of the starting point of said constant acceleration section and the ending point of said constant declaration section dwell sections in which said piston is deactivated, said acceleration section being larger than said deceleration section, and characterized in that the angular displacements $\theta ac$ and $\theta dc$ of the piston corresponding to said constant acceleration section and said constant deceleration section respectively are multiples $m \cdot n$ and $m$ of the piston phase differential angle $\theta_p(=2\pi/M \cdot N)$, where M and N are integers, the angular displacement $\theta cv$ of the piston corresponding to said constant velocity section is a multiple $l$, which is an integer or zero, of the piston phase differential angle $\theta p$, and the sum $\epsilon_1 + \epsilon_2$ of the angular displacements corresponding to said swell sections is determined in accordance with the following equation:

$$\epsilon_1 + \epsilon_2 = \{(M/2) - m(n+1) - l\}\theta p,$$

where M is the number of pistons and N is the number of peaks of the cam.

* * * * *